US006122608A

United States Patent [19]

McCree

[11] Patent Number: 6,122,608

[45] Date of Patent: Sep. 19, 2000

[54] METHOD FOR SWITCHED-PREDICTIVE QUANTIZATION

[75] Inventor: Alan V. McCree, Dallas, Tex.

[73] Assignee: Texas Instruments Incorporated, Dallas, Tex.

[21] Appl. No.: 09/134,774

[22] Filed: Aug. 15, 1998

Related U.S. Application Data

[60] Provisional application No. 60/057,119, Aug. 28, 1997.

[51] Int. Cl.[7] ..... G10L 19/04

[52] U.S. Cl. ..... 704/219; 704/222; 704/230

[58] Field of Search ..... 704/219, 222, 704/230

[56] References Cited

U.S. PATENT DOCUMENTS

| | | | |
|---|---|---|---|
| 5,293,449 | 3/1994 | Tzeng | 704/223 |
| 5,307,441 | 4/1994 | Tzeng | 704/222 |
| 5,664,053 | 9/1997 | Laflamme et al. | 704/219 |
| 5,774,839 | 6/1998 | Shlomot | 704/222 |
| 5,799,131 | 8/1998 | Taniguchi et al. | 704/204 |
| 5,828,996 | 10/1998 | Iijima et al. | 704/220 |
| 5,915,234 | 6/1999 | Itoh | 704/219 |
| 5,966,688 | 10/1999 | Nandkumar et al. | 704/222 |

FOREIGN PATENT DOCUMENTS

| | | |
|---|---|---|
| 0 751 494 A1 | 1/1997 | European Pat. Off. . |
| 0 899 720 A2 | 3/1999 | European Pat. Off. . |

OTHER PUBLICATIONS

Zarrinkoub et al., Switched Prediction and Quantization of LSP Frequencies, INRS–Telecommunications, pp. 757–760, 1995.

Shlomot, Delayed Decision Switched Prediction Multi–Stage LSF Quantization, Rockwell Telecommunication, pp. 45–46, 1995.

Kim et al., Spectral Envelope Quantization with Noise Rebustness, Human & Computer Interaction Lab, pp. 77–78, 1997.

Poornaiah et al., Design and Implementation of a Programmable bit–rate Multipulse Excited LPC Vocoder for Digital Cellular Radio Applications, pp. 209–215, 1994.

Young et al., Encoding of LPC Spectral Parameters Using Switched–Adaptive Interframe vector prediction, University of California, pp. 402–405, 1988.

LeBlance et al., Efficient Search and Design Procedures for Robust Multi–Stage VQ of LPC Parameters for 4 kb/s Speech Coding, pp. 373–385, 1993.

Alan McCree and Juan Carlos De Martin, "A 1.6 KB/S MELP Coder for Wireless Communications," IEEE, pp. 23–24, 1997

Moo Young Kim, et al. "Spectral Envelope Quantization with Noise Robustness," IEEE, pp. 77–78, 1997.

Houman Zarrinkoub and Paul Mermelstein, "Switched Prediction and Quantization of LSP Frequencies," IEEE, pp. 757–760, 1995.

Ravi P. Ramachandran, "A Two Codebook Format for Robust Quantization of Line Spectral Frequencies," IEEE, pp. 157–167, 1995.

*Primary Examiner*—David R. Hudspeth
*Assistant Examiner*—Abul K. Azad
*Attorney, Agent, or Firm*—Robert L. Troike; Frederick J. Telecky, Jr.

[57] ABSTRACT

A new method for quantization of the LPC coefficients in a speech coder includes an improved form of switched predictive multi-stage vector quantization. The switch predictive quantization includes at least a pair of codebook sets in a MSVQ quantizer and a first and second prediction matrix 24*a* and 24*b* with the first prediction matrix 1 used with codebook set 1 and prediction matrix 2 used with codebook set 2 and the encoder determines which prediction matrix/codebooks set produces the minimum quantization error at detector 35 and control 29 gates the indices with the minimum error out of the speech coder.

21 Claims, 2 Drawing Sheets

METHOD FOR SWITCHED-PREDICTIVE QUANTIZATION

This application claims priority under 35 USC §119(e)(1) of provisional application Ser. No. 60/057,119, filed Aug. 28, 1997.

NOTICE

COPYRIGHT® 1997 TEXAS INSTRUMENTS INCORPORATED

A portion of the disclosure of this patent document contains material which is subject to copyright protection. The copyright owner has no objection to the facsimile reproduction by anyone of the patent document or the patent disclosure, as it appears in the United States Patent and Trademark Office patent file or records, but otherwise reserves all copyright rights whatsoever.

CROSS-REFERENCES TO RELATED APPLICATIONS

This application is related to co-pending provisional application Ser. No. 60/035,764, filed Jan. 6, 1997, entitled, "Multistage Vector Quantization with Efficient Codebook Search", of Wilfred P. LeBlanc, et al. This application is incorporated herein by reference.

This application is also related to McCree, co-pending application Ser. No. 08/650,585, entitled, "Mixed Excitation Linear Prediction with Fractional Pitch," filed May 20, 1996. This application is incorporated herein by reference.

This application is also related to co-pending provisional application Ser. No., filed concurrently with this application entitled "Quantization of Linear Prediction Coefficients Using Perceptual Weighting" of Alan McCree. This application is incorporated herein by reference.

TECHNICAL FIELD OF THE INVENTION

This invention relates to switched-predictive quantization.

BACKGROUND OF THE INVENTION

Many speech coders, such as the new 2.4 kb/s Federal Standard Mixed Excitation Linear Prediction (MELP) coder (McCree, et al., entitled, "A 2.4 kbits/s MELP Coder Candidate for the New U. S. Federal Standard," Proc. ICASSP-96, pp. 200–203, May 1996.) use some form of Linear Predictive Coding (LPC) to represent the spectrum of the speech signal. A MELP coder is described in Applicant's co-pending application Ser. No. 08/650,585, entitled "Mixed Excitation Linear Prediction with Fractional Pitch," filed May 20, 1996, incorporated herein by reference. FIG. 1 illustrates such a MELP coder. The MELP coder is based on the traditional LPC vocoder with either a periodic impulse train or white notice exciting a 10th order on all-pole LPC filter. In the enhanced version, the synthesizer has the added capabilities of mixed pulse and noise excitation periodic or aperiodic pulses, adaptive spectral enhancement and pulse dispersion filter as shown in FIG. 1. Efficient quantization of the LPC coefficients is an important problem in these coders, since maintaining accuracy of the LPC has a significant effect on processed speech quality, but the bit rate of the LPC quantizer must be low in order to keep the overall bit rate of the speech coder small. The MELP coder for the new Federal Standard uses a 25-bit multi-stage vector quantizer (MSVQ) for line spectral frequencies (LSF). There is a 1 to 1 transformation between the LPC coefficients and LSF coefficients.

Quantization is the process of converting input values into discrete values in accordance with some fidelity criterion. A typical example of quantization is the conversion of a continuous amplitude signal into discrete amplitude values. The signal is first sampled, then quantized.

For quantization, a range of expected values of the input signal is divided into a series of subranges. Each subrange has an associated quantization level. For example, for quantization to 8-bit values, there would be 256 levels. A sample value of the input signal that is within a certain subrange is converted to the associated quantizing level. For example, for 8-bit quantization, a sample of the input signal would be converted to one of 256 levels, each level represented by an 8-bit value.

Vector quantization is a method of quantization, which is based on the linear and non-linear correlation between samples and the shape of the probability distribution. Essentially, vector quantization is a lookup process, where the lookup table is referred to as a "codebook". The codebook lists each quantization level, and each level has an associated "code-vector". The vector quantization process compares an input vector to the code-vectors and determines the best code-vector in terms of minimum distortion. Where x is the input vector, the comparison of distortion values may be expressed as:

$$d(x, y^{(j)}) \leqq d(x, y^{(k)}),$$

for all j not equal to k. The codebook is represented by $y^{(j)}$, where $y^{(j)}$ is the jth code-vector, $0 \leqq j \leqq L$, and L is the number of levels in the codebook.

Multi-stage vector quantization (MSVQ) is a type of vector quantization. This process obtains a central quantized vector (the output vector) by adding a number of quantized vectors. The output vector is sometimes referred to as a "reconstructed" vector. Each vector used in the reconstruction is from a different codebook, each codebook corresponding to a "stage" of the quantization process. Each codebook is designed especially for a stage of the search. An input vector is quantized with the first codebook, and the resulting error vector is quantized with the second codebook, etc. The set of vectors used in the reconstruction may be expressed as:

$$y^{(j_0, j_1, \cdots j_{S-1})} = y_0^{(j_0)} + y_1^{(j_1)} + y_{S-1}^{(j_{S-1})},$$

where S is the number of stages and $y_s$ is the codebook for the sth stage. For example, for a three-dimensional input vector, such as x=(2,3,4), the reconstruction vectors for a two-stage search might be $y_0$=(1,2,3) and $y_1$=(1,1,1) (a perfect quantization and not always the case).

During multi-stage vector quantization, the codebooks may be searched using a sub-optimal tree search algorithm, also known as an M-algorithm. At each stage, M-best number of "best" code-vectors are passed from one stage to the next. The "best" code-vectors are selected in terms of minimum distortion. The search continues until the final stage, when only one best code-vector is determined.

In predictive quantization a target vector for quantization in the current frame is the mean-removed input vector minus a predictive value. The predicted value is the previous quantized vector multiplied by a known prediction matrix. In switched prediction, there is more than one possible prediction matrix and the best prediction matrix is selected for each frame. See S. Wang, et al., "Product Code Vector Quantization of LPC Parameters," in Speech and Audio Coding for Wireless and Network Applications," Ch. 31, pp. 251–258, Kluwer Academic Publishers, 1993.

It is highly desirable to provide an improved method for switched-predictive vector quantization.

SUMMARY OF THE INVENTION

In accordance with one embodiment of the present invention, an improved method and system of switched predictive quantization wherein prediction/codebook sets are switched to take advantage of time redundancy.

These and other features of the invention that will be apparent to those skilled in the art from the following detailed description of the invention, taken together with the accompanying drawings.

DESCRIPTION OF PREFERRED EMBODIMENTS OF THE PRESENT INVENTION

The new quantization method, like the one used in the 2.4 kb/s Federal Standard MELP coder, uses multi-stage vector quantization (MSVQ) of the Line Spectral Frequency (LSF) transformation of the LPC coefficients (LeBlanc, et al., entitled "Efficient Search and Design Procedures for Robust Multi-Stage VQ or LPC Parameters for 4 kb/s Speech Coding," IEEE Transactions on Speech and Audio Processing, Vol. 1, No. 4, October 1993, pp. 373–385.) An efficient codebook search for multi-stage VQ is disclosed in application Ser. No. 60/035,764 cited above. However, the new method, according to the present invention, improves on the previous one in two ways: the use of switched prediction to take advantage of time redundancy and the use of a new weighted distance measure that better correlates with subjective speech quality.

In the Federal Standard MELP coder, the input LSF vector is quantized directly using MSVQ. However, there is a significant redundancy between LSF vectors of neighboring frames, and quantization accuracy can be improved by exploiting this redundancy. As discussed previously in predictive quantization, the target vector for quantization in the current frame is the mean-removed input vector minus a predicted value, where the predicted value is the previous quantized vector multiplied by a known prediction matrix. In switched prediction, there is more than one possible prediction matrix, and the best predictor or prediction matrix is selected for each frame. In accordance with the present invention, both the predictor matrix and the MSVQ codebooks are switched. For each input frame, we search every possible predictor/codebooks set combination for the predictor/codebooks set which minimizes the squared error. An index corresponding to this pair and the MSVQ codebook indices are then encoded for transmission. This differs from previous techniques in that the codebooks are switched as well as the predictors. Traditional methods share a single codebook set in order to reduce codebook storage, but we have found that the MSVQ codebooks used in switched predictive quantization can be considerably smaller than non-predictive codebooks, and that multiple smaller codebooks do not require any more storage space than one larger codebook. From our experiments, the use of separate predictor/codebooks pairs results in a significant performance improvement over a single shared codebook, with no increase in bit rate.

Figure 2:
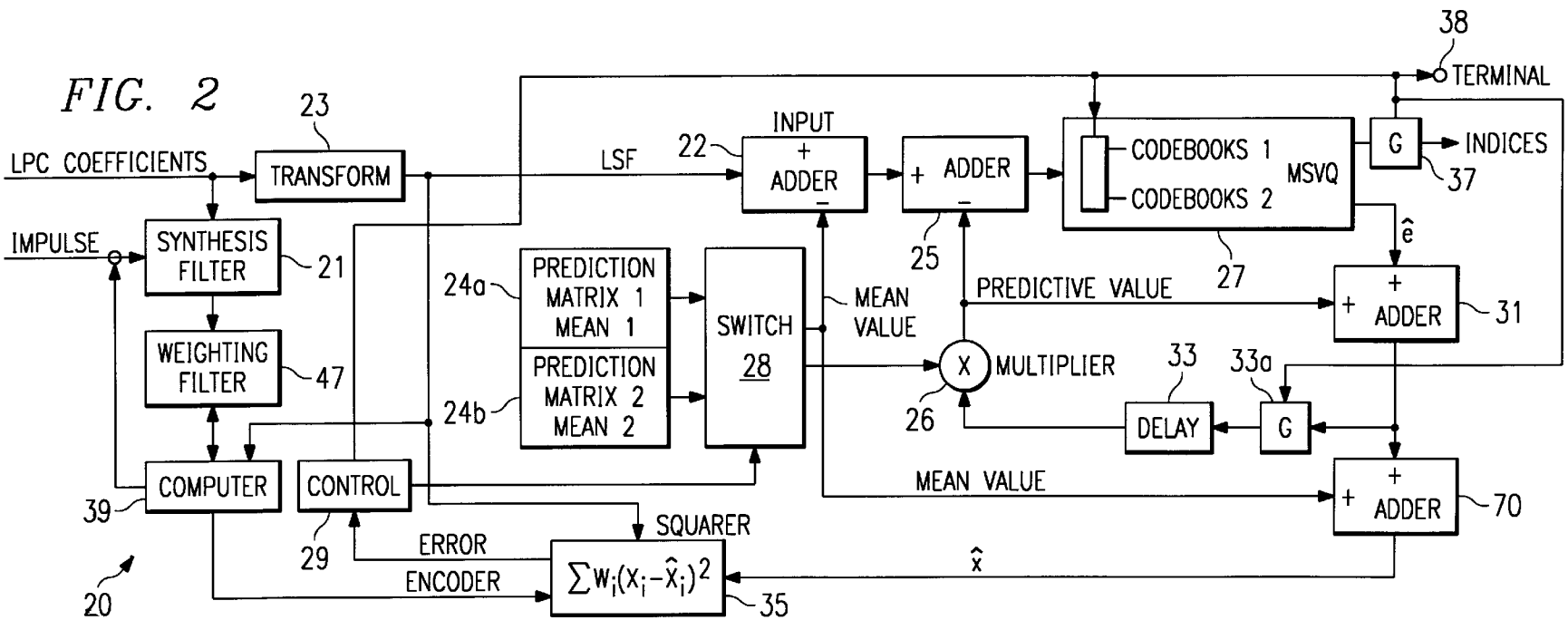
FIG. 2 is a block diagram of switch-predictive vector quantization encoder according to the present invention.

Referring to the LSF encoder with switched predictive quantizer 20 of FIG. 2, the 10 LPC coefficients are transformed by transformer 23 to 10 LSF coefficients of the Line Spectral Frequency (LSF) vectors. The LSF has 10 dimensional elements or coefficients (for 10 order all-pole filter). The LSF input vector is subtracted in adder 22 by a selected mean vector and the mean-removed input vector is subtracted in adder 25 by a predicted value. The resulting target vector for quantization vector e in the current frame is applied to multi-stage vector quantizer (MSVQ) 27. The predicted value is the previous quantized vector multiplied by a known prediction matrix at multiplier 26. The predicted value in switched prediction has more than one possible prediction matrix. The best predictor (prediction matrix and mean vector) is selected for each frame. In accordance with the present invention, both the predictor (the prediction matrix and mean vector) and the MSVQ codebook set are switched. A control 29 first switches in via switch 28 prediction matrix 1 and mean vector 1 and first set of codebooks 1 in quantizer 27. The index corresponding to this first prediction matrix and the MSVQ codebook indices for the first set of codebooks are then provided out of the quantizer to gate 37. The predicted value is added to the quantized output ê for the target vector e at adder 31 to produce a quantized mean-removed vector. The mean-removed vector is added at Adder 70 to the selected mean vector to get quantized vector $\hat{X}$. The squared error for each dimension is determined at squarer 35. The weighted squared error between the input vector $X_i$ and the delayed quantized vector $\hat{X}_i$ is stored at control 29. The control 29 applies control signals to switch in via switch 28 prediction matrix 2 and mean vector 2 and codebook 2 set to likewise measure the weighted squared error for this set at squarer 35. The measured error from the first pair of prediction matrix 1 (with mean vector 1) and codebooks set 1 is compared with prediction matrix 2 (with mean vector 2) and codebook set 2. The set of indices for the codebooks with the minimum error is gated at gate 37 out of the encoder as encoded transmission of indices and a bit is sent out at terminal 38 from control 29 indicating from which pair of prediction matrix and codebooks set the indices was sent (codebook set 1 with mean vector 1 and predictor matrix 1 or codebook set 2 and prediction matrix 2 with mean vector 2). The mean-removed quantized vector from adder 31 associated with the minimum error is gated at gate 33*a* to frame delay 33 so as to provide the previous mean-removed quantized vector to multiplier 26.

Figure 3:
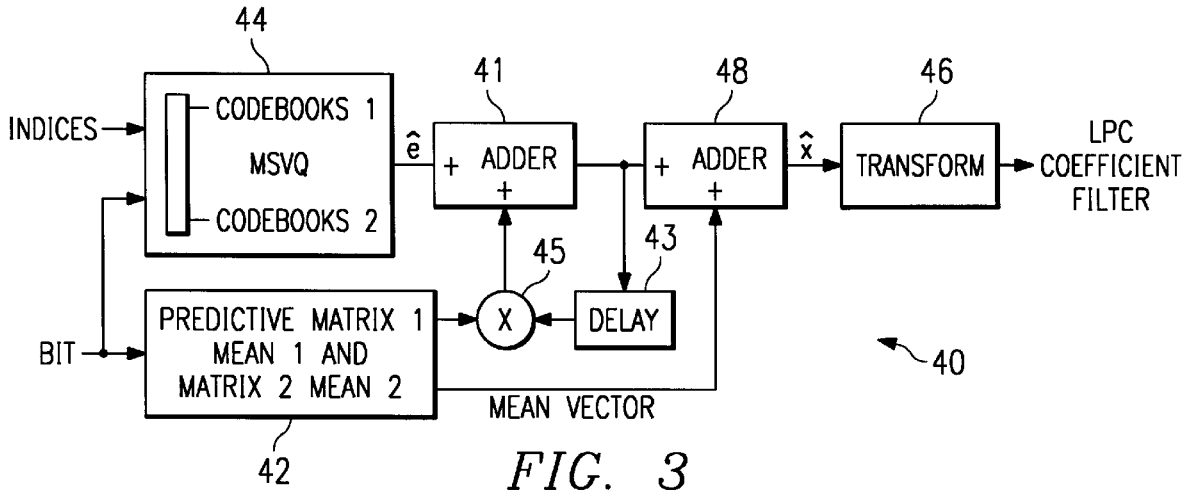
FIG. 3 is a block diagram of a decoder according to the present invention.

FIG. 3 illustrates a decoder 40 for use with LSF encoder 20. At the decoder 40, the indices for the codebooks from the encoding are received at the quantizer 44 with two sets of codebooks corresponding to codebook set 1 and 2 in the encoder. The bit from terminal 38 selects the appropriate codebook set used in the encoder. The LSF quantized input is added to the predicted value at adder 41 where the predicted value is the previous mean-removed quantized value (from delay 43) multiplied at multiplier 45 by the prediction matrix at 42 that matches the best one selected at the encoder to get mean-removed quantized vector. Both prediction matrix 1 and mean value 1 and prediction matrix 2 and mean value 2 are stored at storage 42 of the decoder. The 1 bit from terminal 38 of the encoder selects the prediction matrix and the mean value at storage 42 that matches the encoder prediction matrix and mean value. The quantized mean-removed vector is added to the selected mean value at adder 48 to get the quantized LSF vector. The quantized LSF vector is transformed to LPC coefficients by transformer 46.

As discussed previously, LSF vector coefficients correspond to the LPC coefficients. The LSF vector coefficients have better quantization properties than LPC coefficients. There is a 1 to 1 transformation between these two vector coefficients. A weighting function is applied for a particular set of LSFs for a particular set of LPC coefficients that correspond.

Figure 1:
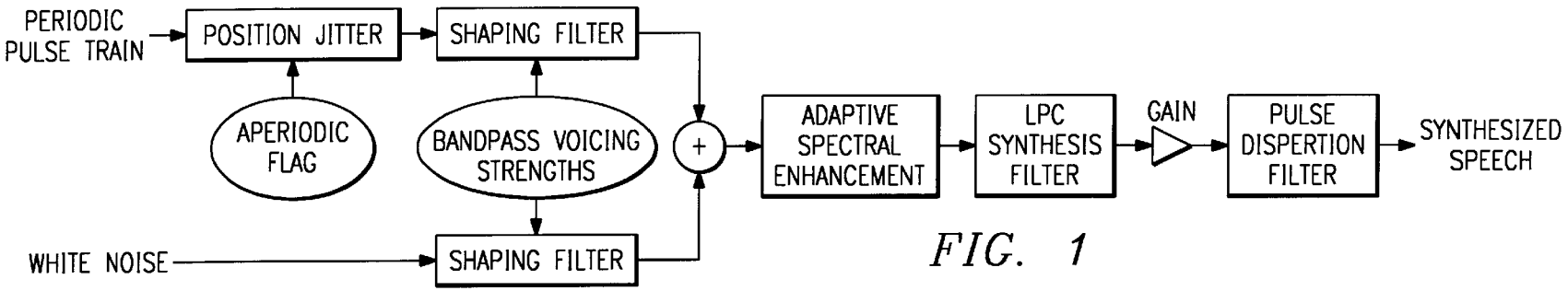
FIG. 1 is a block diagram of Mixed Excitation Linear Prediction Coder.

The Federal Standard MELP coder uses a weighted Euclidean distance for LSF quantization due to its computational simplicity. However, this distance in the LSF domain does not necessarily correspond well with the ideal measure of quantization accuracy: perceived quality of the processed speech signal. Applicant has previously shown in the paper on the new 2.4 kb/s Federal Standard that a perceptually-weighted form of log spectral distortion has close correlation with subjective speech quality. Applicant teaches herein in accordance with an embodiment a weighted LSF distance which corresponds closely to this spectral distortion. This weighting function requires looking into the details of this transformation for a particular set of LSFs for a particular input vector x which is a set of LSFs for a particular set of LPC coefficients that correspond to that set. The coder computes the LPC coefficients and as discussed above, for purposes of quantization, this is converted to LSF vectors which are better behaved. As shown in FIG. 1, the actual synthesizer will take the quantized vector $\hat{X}$ and perform an inverse transformation to get an LPC filter for use in the actual speech synthesis. The optimal LSF weights for unweighted spectral distortion are computed using the formula presented in paper of Gardner, et al., entitled, "Theoretical Analysis of the High-Rate Vector Quantization of the LPC Parameters," IEEE Transactions on Speech and Audio Processing, Vol. 3, No. 5, September 1995, pp. 367–381.

$$W_i = R_A(0)R_i(0) + 2\sum_{m=1}^{p-1} R_A(m)R_i(m)$$

where $R_A(m)$ is the autocorrelation of the impulse response of the LPC synthesis filter at lag m, and $R_i(m)$ is the correlation of the elements in the ith column of the Jacobian matrix of the transformation from LSF's to LPC coefficients. Therefore for a particular input vector x we compute the weight $W_i$.

The difference in the present solution is that perceptual weighting is applied to the synthesis filter impulse response prior to computation of the autocorrelation function $R_A(m)$, so as to reflect a perceptually-weighted form of spectral distortion.

In accordance with the weighting function as applies to the embodiment of FIG. 2, the weighting $W_i$ is applied to the squared error at 35. The weighted output from error detector 35 is $\Sigma W_i(X_i-\hat{X}_i)^2$. Each entry in a 10 dimensional vector has a weight value. The error sums the weight value for each element. In applying the weight, for example, one of the elements has a weight value of three and the others are one then the element with three is given an emphasis by a factor of three times to that of the other elements in determining error.

As stated previously, the weighting function requires looking into the details of the LPC to LSF conversion. The weight values are determined by applying an impulse to the LPC synthesis filter 21 and providing the resultant sampled output of the LPC synthesis filter 21 to a perceptual weighting filter 47. A computer 39 is programmed with a code based on a pseudo code that follows and is illustrated in the flow chart of FIG. 4. An impulse is gated to the LPC filter 21 and N samples of LPC synthesis filter response (step 51) are taken and applied to a perceptual weighting filter 37 (step 52). In accordance with one preferred embodiment of the present invention low frequencies are weighted more than high frequencies and in particular the preferred embodiment uses the well known Bark scale which matches how the human ear responds to sounds. The equation for Bark weighting $W_B(f)$ is $$W_B(f) = \frac{1}{25 + 75\left(1 + 1.4\left(\frac{f}{1000}\right)^2\right)^{0.69}}$$

The coefficients of a filter with this response are determined in advance and stored and time domain coefficients are stored. An 8 order all-pole fit to this spectrum is determined and these 8 coefficients are used as the perceptual weighting filter. The following steps follow the equation for un-weighted spectral distortion from Gardner, et al. paper found on page 375 expressed as $$W_i = R_A(0)R_i(0) + 2\sum_{m=1}^{p-1} R_A(m)R_i(m)$$

where $R_A(m)$ is the autocorrelation of the impulse response of the LPC synthesis filter at lag m, where $$R_A(k) = \sum_{n=0}^{\alpha} h(n)h(n+k)$$

h(n) is an impulse response, $R_i(m)$ is $$R_{j_i}(m) = \sum_{n-1}^{v-m} (J_\omega(\omega))_{n,i}(J_\omega(\omega))_{m+n,i} = \sum_{n-1}^{v-m} j_i(n)j_i(m+n)$$

is the correlation function of the elements in the ith column of the Jacobian matrix $J_\omega(\omega)$ of the transformation from LSFs to LPC coefficients. Each column of $J_\omega(\omega)$ can be found by $$= \begin{cases} \sin(\omega_i)e^{-j\omega} \prod_{j=o:j\neq(i+1)/2}^{v/2} \tilde{p}_j(\omega);\ i \text{ odd} \\ \sin(\omega_i)e^{-j\omega} \prod_{j=o:j\neq i/2}^{v/2} \tilde{q}_j(\omega);\ i \text{ even} \end{cases}$$

since $$\prod_{j=o:j\neq i}^{v/2} \tilde{p}_j(\omega) = P(\omega)/\tilde{p}_i(\omega)$$

The values of $j_i(n)$ can be found by simple polynomial division of the coefficients of $P(\omega)$ by the coefficients of $\tilde{p}_i(\omega)$. Since the first coefficient of $\tilde{p}_i(\omega)=1$, no actual divisions are necessary in this procedure. Also, $j_i(n)=j_i(v+1-n)$: i odd; $0<n\leqq v$, so only half the values must be computed. Similar conditions with an anti-symmetry property exist for the even columns.

Figure 4:
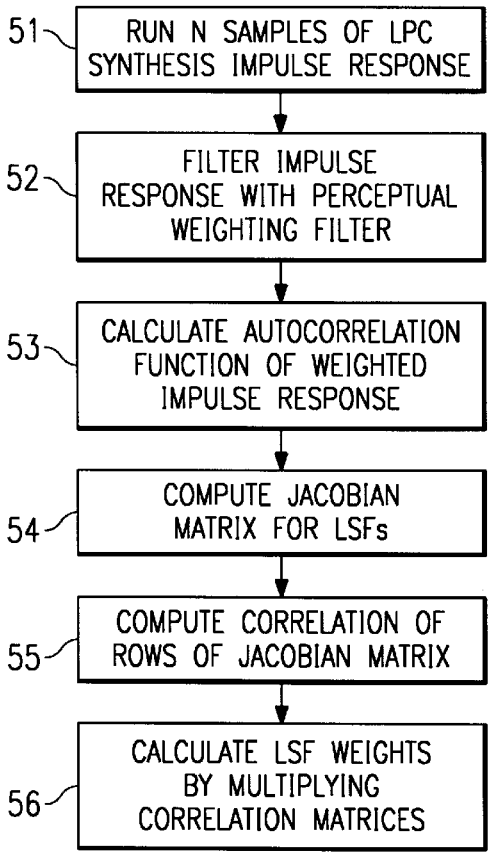
FIG. 4 is a flow chart for determining a weighted distance measure in accordance with another embodiment of the present invention.

The autocorrelation function of the weighted impulse response is calculated (step 53 in FIG. 4). From that the Jacobian matrix for LSFs is computed (step 54). The correlation of rows of Jacobian matrix is then computed (step 55). The LSF weights are then calculated by multiplying correlation matrices (step 56). The computed weight value from computer 39, in FIG. 2, is applied to the error detector 35. The indices from the prediction matrix/codebook set with the least error is then gated from the quantizer 27. The system may be implemented using a microprocessor encapsulating computer 39 and control 29 utilizing the following pseudo code. The pseudo code for computing the weighting vector from the current LPC and LSF follows:

/* Compute weighting vector from current LPC and LSF's */

Compute N samples of LPC synthesis filter impulse response

Filter impulse response with perceptual weighting filter

Calculate the autocorrelation function of the weighted impulse response

Compute Jacobian matrix for LSF's

Compute correlation of rows of Jacobian matrix

Calculate LSF weights by multiplying correlation matrices

The code for the above is provided in Appendix A.

The pseudo code for the encode input vector follows:

/* Encode input vector */

For all predictor, codebook pairs

Remove mean from input LSF vector

Subtract predicted value to get target vector

Search MSVQ codebooks for best match to target vector using weighted distance

If Error<Emin

Emin=Error best predictor index=current predictor

Endif

End

Endcode best predictor index and codebook indices for transmission

The pseudo code for regenerate quantized vector follows:

/* Regenerate quantized vector */

Sum MSVQ codevectors to produce quantized target

Add predicted value

Update memory of past quantized values (mean-removed)

Add mean to produce quantized LSF vector

We have implemented a 20-bit LSF quantizer based on this new approach which produces equivalent performance to the 25-bit quantizer used in the Federal Standard MELP coder, at a lower bit rate. There are two predictor/codebook pairs, with each consisting of a diagonal first-order prediction matrix and a four stage MSVQ with codebook of size 64, 32, 16, and 16 vectors each. Both the codebook storage and computational complexity of this new quantizer are less than in the previous version.

Although the present invention and its advantages have been described in detail, it should be understood that various changes, substitutions and alterations can be made herein without departing from the spirit and scope of the invention as defined by the appended claims.

For example it is anticipated that combinations of prediction matrix 1 may be used with codebook set 2 and prediction matrix 2 with codebook set 1 or any combination of codebook set and prediction matrix. There could be many more codebook sets and or prediction matrices. Such combinations require additional bits be sent from the encoder. There could be only one mean vector or many mean vectors. This switched predictive quantization can be used for vectors other than LSF but may also be applied to scalar quantization and in that case matrix as used herein may be a scalar value.

APPENDIX A

```
/* Function vq_lspw: compute LSF weights
    Inputs:
      *p_lsp - LSF array
      *pc - LPC coefficients
      p - LPC model order
    Output:
      *w - array of weights
    Copyright 1997, Texas Instruments
*/
Float *vq_lspw(Float *w,Float *p_lsp, Float *pc,Int p)
{
      Int i, j, k, m;
      Float d, tmp, *tp, *ir, *R, *pz, *qz, *rem, *t, **J, **RJ;
      static Float bark_wt[8] = {
        -0.84602182,
        0.27673657,
        -0.10480262,
        0.05609138,k
        -0.03315923,
        0.02132074,
        -0.01359822,
        0.00598910,
      }:
      /* Allocate local array memory */
      MEM_ALLOC(MALLOC, ir, IRLENGTH+p, Float);
      ir=&ir[p];
      MEM_ALLOC(MALLOC,R,p,Float);
      MEM_ALLOC(MALLOC,pz,p+2,Float);
      MEM_ALLOC(MALLOC,qz,p+2,Float);
      MEM_ALLOC(MALLOC,rem,p+2,Float);
      MEM_ALLOC(MALLOC,t, 3,Float);
      MEM_ALLOC(MALLOC,J,p+1,p+1,Float);
      MEM_ALLOC(MALLOC,RJ,p+1,p,Float);
      /* calculate IRLENGTH samples of the synthesis
      filter impulse response*/
      for (i=-p; i<IRLENGTH; i++)
        ir[i] = 0.0;
      ir[0] = 1.0;
      for (i=0; i<IRLENGTH; i++)
      {
        for (j=1; j<=p; j++)
          ir[i] -= pc[j] * ir[i-j];
      }
      /* use all-pole model for frequency weighting */
      for (i=0; i<IRLENGTH; i++)
      {
        for (j=1; j<=8; j++)
          ir[i]; -= bark_wt[j-1] * ir[i-j];
      }
      /* calculate the autocorrelation function of the impulse response */
      for (m=0; m<p; m++)      /* for lags of 0 to p-1 */
      {
        R[m] = 0.0f;
        for (i=0; i<IRLENGTH-m; i++)
          R[m] += ir[i] * ir[i+m];
      }
      /* calculate P(z) and Q(z) */
      for (i=1; i<=p; i++)
      {
        pz[i] = pc[i] + pc[p+1-i];
        pz[i] = pc[i] - pc[p+1-i];
      }
      pz[0] = qz[0] = pz[p+1] = 1.0f;
      qz([p+1] = -1.0f;
      /* calculate the J matrix */
```

APPENDIX A-continued

```
    /* use the rows of J to store the polynomials */
    /* (rather than the columns, as in Gardner) */
    t [0] = t[2] = 1.0f;
    for (i=1; i<=p; i++)                /* for all the rows of J */
    {
      t[1] = -2.0f * cos(PI * p_lsp*(i));
      tmp = sin(PI * p_lsp[i]):
      if (i != 2 * (i/2)) tp = pz;  /* i is odd; use p(z) */
      else          tp = qz;        /* i is even; use q(z) */
      /* divide polynomial tp by polynomial t and put the result into */
      /* row J[i] */
      for (j=0; j<=p+1, j++)
        rem[j] = tp[j];
      for (k=p; k<=1; k--)
      {
        J[i][k] = rem[k+1];
        for (j=k; j>=k-1; j--)
        rem[j] -= J[i][k] * t[j-k+1];
      }
      /* multiply the ith row by the sin ( ) term */
      for (j=1; j<=p; j++)
        J[i][j] *= tmp;
      }
      /* determine the 'correlation' function of the rows of J */
      for (i=1; i<=p; i++)              /* for each row */
      {
      for (m=0; m<p; m++)       /* for each lag */
      {
          RJ[i][m] = 0.0f;
          /* for each element in the row */
          for (j=1; j<=p-m; j++)
              RJ[i][m] += j[i][j] * J[i][j+m];
        }
    }
    /* finish the weight calculation */
    for (i=1; i<=p; i++)
    {
      tmp = 0.0f;
      for (m=1; m<p; m++)
        tmp += R[m] * RJ[i][m];
      w[i-1] = R[0] * RJ[i][0] + 2.0f * tmp;
    }
    /* Free local memory */
    ir=&ir[-p];
    MEM_FREE(FREE, ir);
    MEM_FREE(FREE, R);
    MEM_FREE(FREE, pz);
    MEM_FREE(FREE, qz);
    MEM_FREE(FREE, rem);
    MEM_FREE(FREE, t);
    MEM_2FREE(FREE, J);
    MEM_2FREE(FREE, RJ);
    return (w);
}
```

What is claimed is:

1. A switched predictive method of quantizing an input signal comprising the steps of:

generating a set of parameters associated with said input signal;

providing a first mean value and subtracting said first mean value from said set of parameters to get first mean-removed input;

providing a second mean value and subtracting said second mean value from said set of parameters to get second mean-removed input;

providing a quantizer with a first set of codebooks and second set of codebooks;

providing a first prediction matrix and a second prediction matrix;

multiplying a previous frame mean-removed quantized value to said first prediction matrix then said second prediction matrix to get first predicted value and then second predicted value;

subtracting said first predicted value from said first mean-removed input to get first target value and subtracting said second predicted value from said second mean-removed input to get second target value;

applying said first target value to said first set of codebooks to get first quantized target value and applying said second target value to said second set of codebooks to get second quantized target value;

adding said first predicted value to said first quantized target value to get first mean-removed quantized value and adding said second predicted value to said second quantized target value to get second mean-removed quantized value;

adding said first mean value to said first mean-removed quantized value to get first quantized value and adding said second mean value to said second mean-removed quantized value to get second quantized value; and determining which set of codebooks and prediction matrix has minimum error and selectively providing an output signal representing the quantized value corresponding to that codebook set with minimum error.

2. The method of claim 1 wherein said quantizer is a multi-stage vector quantizer.

3. The method of claim 1 wherein said set of parameters is LSF coefficients corresponding to a set of LPC coefficients.

4. The method of claim 3 wherein said determining step includes the step of determining the squared error for each dimension between the input vector and the quantized output.

5. The method of claim 4 wherein said squared error is multiplied by a weighting value for each dimension.

6. The method of claim 5 wherein the weighting function is a Euclidean distance for LSF quantization.

7. The method of claim 4 wherein said weighting function is a weighted LSF distance which corresponds closely to a perceptually weighted form of spectral distortion.

8. In a communication system for communicating for communicating input signals comprising an encoder which receives and processes said input signals to generate a quantized data vector for transmission, the encoder providing LPC coefficients to generate a quantized data vector, a method for quantization of LPC coefficients comprising the steps of:

translating LPC coefficients to LSF coefficients;

providing a quantizer with a first set of codebooks and second set of codebooks;

providing a first mean value and subtracting said first mean value from said LSF coefficients to get first mean-removed input LSF coefficients and providing a second mean value and subtracting said second mean value from said LSF coefficients to get second mean-removed input LSF coefficients;

providing a first prediction matrix and a second prediction matrix;

multiplying a previous frame mean-removed quantized vector by said first prediction matrix then said second prediction matrix to get first predicted value and second predicted value;

subtracting said first predicted value from said first mean-removed input LSF coefficients to get first target vector and subtracting said second predicted value from said second mean-removed input LSF coefficients to get second target vector;

applying said first target vector to said first set of codebooks to get first quantized target vector and applying said second target vector to said second set of codebooks to get second quantized target vector;

adding said first predicted value to said first quantized target vector to get first mean-removed quantized value and adding said second predicted value to said second quantized target vector to get second mean-removed quantized value;

adding said first mean value to said first mean-removed quantized value to get first quantized value and adding said second mean value to said second mean-removed quantized value to get second quantized value; and determining which set of codebooks and prediction matrix has minimum error between said LSF coefficients and said quantized output value and selectively providing an output signal corresponding to the indices representing the set of codebooks and prediction matrix with minimum error as the output.

9. The method of claim 8 wherein said determining step includes the step of determining the squared error for each dimension between the input vector and the delayed quantized vector.

10. The method of claim 9 wherein said squared error is multiplied by a weighting value for each dimension.

11. The method of claim 10 wherein the weighing value is a Euclidean distance for LSF quantization.

12. The method of claim 10 wherein said weighting function is a weighted LSF distance which corresponds closely to a perceptually weighted form of spectral distortion.

13. In a Linear Prediction Coder which receives and processes input signals to generate a quantized data vector for either transmission or storage in a digital medium, the coder responsive to said input signals to generate a set of LPC coefficients associated with the input signals, and a quantizer for quantizing a sequence of data vectors from among the set of LPC coefficients corresponding to said input signals to generate the quantized data vector, the quantizer comprising:

means for translating LPC coefficients to LSF coefficients;

a quantizer including first set of codebooks and second set of codebooks;

means for providing a first mean value and a second mean value and means for subtracting said first mean value and said second mean value from said input LSF coefficients to get first mean-removed input LSF coefficients and said second mean-removed input LSF coefficients;

a first prediction matrix and second prediction matrix;

a multiplier coupled to said first prediction matrix and said second prediction matrix and a previous frame mean-removed quantized vector for multiplying a previous frame quantized vector by said first prediction matrix and then said second prediction matrix to get first predicted value and second predicted value;

means for subtracting said first predicted value from said first mean-removed input LSF coeffecients to get first target vector and means for subtracting said second predicted value from said second mean-removed input LSF coefficients to get second target vector;

means for applying said first target vector to said first set of codebooks to get first quantized target value and for applying said second target vector to said second set of codebooks to get second quantized target value;

means for adding said first predicted value to said first quantized target value to get first mean-removed quantized value and means for adding said second predicted value to said second quantized target value to get second mean-removed quantized value;

means for adding said first mean value to said first mean-removed quantized value to get first quantized value and means for adding said second mean value to said second mean-removed quantized value to get second quantized value; and means coupled to said translating means and said codebooks output for determining which set of codebooks and prediction matrix has minimum error between said LSF coefficients and said quantized output and selectively gating an output signal representing the indices representing the codebook set and prediction matrix with minimum error as the output from said coder.

14. The coder of claim 13 wherein said means for determining step includes means for determining the squared error for each dimension between the input vector and the quantized output.

15. The coder of claim 14 wherein said squared error is multiplied by a weighting value for each dimension.

16. The coder of claim 15 wherein the weighting value is an Euclidean distance for LSF quantization.

17. The coder of claim 16 wherein said weighting function is a weighted LSF distance which corresponds closely to a perceptually weighted form of spectral distortion.

18. The coder of claim 15 wherein said quantizer is a multi-stage vector quantizer.

19. A method of vector quantization of an input signal representing LPC coefficients comprising the steps of:

translating said input signal representing LPC coefficients to LSF coefficients;

providing a quantizer with a first set of codebooks and a second set of codebooks for quantizing LSF target vectors;

providing a first mean value and subtracting said first mean value from said LSF coefficients to get first mean-removed input and providing a second mean value and subtracting said second mean value from said LSF coefficients to get second mean-removed input;

providing a first prediction matrix and a second prediction matrix;

multiplying a previous frame mean-removed quantized vector to said first prediction matrix and then second prediction matrix to get first predicted value and then second predicted value;

subtracting said first predicted value from said first mean-removed input to get first target vector and subtracting said second predicted value from said second mean-removed input to get second target vector;

applying said first target vector to said first set of codebooks to get first quantized vector and applying said second target vector to said second set of codebooks to get second quantized vector;

adding said first predicted value to said first quantized target vectors to get first mean-removed quantized value and adding said second predicted value to said second quantized target vector to get second mean-removed quantized value;

adding said first mean-removed quantized value to said first mean value to get first quantized value and adding said second mean-removed quantized value to said second mean value to get second quantized value;

determining which prediction matrix has minimum quantization error between said LPC coefficients and said quantized output and selectively gating an output signal representing the indices representing the codebook set and prediction with minimum error as the output; and said determining step includes determining the squared error multiplied by a weighting value for each dimension between the LPC coefficients and the quantized output wherein said weighting value is a function of perceptual weighting.

20. The method of claim 19 wherein said perceptual weighting is a function of bark scale.

21. The method of claim 19 wherein said weighting value is determined by the steps of applying an impulse to said LPC filter and running N samples of the LPC synthesis response; filtering the samples with a perceptual filter; calculating autocorrelation function of weighted impulse response; computing Jacobian matrix for said LSFs; computing correlation of rows of Jacobian matrix; and calculating LSF weights by multiplying correlation matrices.

* * * * *